US008815039B2

(12) United States Patent
Wild et al.

(10) Patent No.: US 8,815,039 B2
(45) Date of Patent: Aug. 26, 2014

(54) APPLICATION OF A PROCESSING PIN TO A GEMSTONE WHICH IS TO BE CUT OR POLISHED

(75) Inventors: Markus Paul Wild, Kirschweiler (DE); Stefan Koehler, Roetsweiler-Nockenthal (DE)

(73) Assignee: Paul Wild OHG, Kirschweiler (DE)

( * ) Notice: Subject to any disclaimer, the term of this patent is extended or adjusted under 35 U.S.C. 154(b) by 801 days.

(21) Appl. No.: 12/810,079

(22) PCT Filed: Dec. 23, 2008

(86) PCT No.: PCT/EP2008/068243

§ 371 (c)(1),
(2), (4) Date: Sep. 22, 2010

(87) PCT Pub. No.: WO2009/083556

PCT Pub. Date: Jul. 9, 2009

(65) Prior Publication Data

US 2011/0048626 A1 Mar. 3, 2011

(30) Foreign Application Priority Data

Dec. 23, 2007 (DE) ..... 10 2007 062 638
Jul. 31, 2008 (DE) ..... 10 2008 035 730

(51) Int. Cl.
*B32B 38/10* (2006.01)

(52) U.S. Cl.
USPC ..... 156/230; 156/249; 156/711; 29/426.2; 29/426.5

(58) Field of Classification Search
USPC ..... 156/711, 230, 249
See application file for complete search history.

(56) References Cited

U.S. PATENT DOCUMENTS 2,641,879 A * 6/1953 Dalrymple ..... 451/53
2,724,220 A * 11/1955 Shaw ..... 451/278

(Continued)

FOREIGN PATENT DOCUMENTS

AT 90548 12/1922
DE 85 04 419 5/1986

(Continued)

OTHER PUBLICATIONS

International Search Report for PCT/EP2008/068243; mailed Sep. 16, 2009; 4 pages.

(Continued)

*Primary Examiner* — Mark A Osele
(74) *Attorney, Agent, or Firm* — Hunton & Williams LLP

(57) ABSTRACT

A next processing pin is applied as a follow-on pin to a stone, wherein the stone is held by a preceding pin and fixed to the stone by way of a first adhesive bonding location. The preceding pin is separated from the stone. The follow-on pin is fixed to the stone by way of a second adhesive bonding location spaced from the first adhesive bonding location. The follow-on pin frontally receives a fluid adhesive at a spacing from the stone and the spacing between the adhesive-coated front end and the stone is reduced until the adhesive front end contacts the stone. The adhesive is hardened at the contact location as the second adhesive bonding location and heat is transferred by way of the preceding pin to the first adhesive bonding location A force component is exerted on the preceding pin to release the pin from the stone and to hold the stone with the next pin.

28 Claims, 14 Drawing Sheets

(56) References Cited

U.S. PATENT DOCUMENTS

| | | | | | |
|---|---|---|---|---|---|
| 2,896,477 | A | * | 7/1959 | Miller | 76/101.1 |
| 3,323,259 | A | * | 6/1967 | Stout | 451/389 |
| 3,902,285 | A | * | 9/1975 | Lalish | 451/389 |
| 3,940,888 | A | | 3/1976 | Wain | |
| 4,206,864 | A | * | 6/1980 | Rauchwerger | 228/20.5 |
| 4,632,294 | A | * | 12/1986 | Druschel et al. | 228/119 |
| 4,715,148 | A | | 12/1987 | Landgraf | |
| 4,855,562 | A | * | 8/1989 | Hinden | 219/93 |
| 4,955,162 | A | * | 9/1990 | Jackson | 451/279 |
| 5,762,896 | A | * | 6/1998 | Hunter et al. | 423/345 |
| 7,691,221 | B2 | | 4/2010 | Swarovski | |
| 2004/0016741 | A1 | * | 1/2004 | Evanyk | 219/221 |
| 2008/0156426 | A1 | | 7/2008 | Swarovski | |

FOREIGN PATENT DOCUMENTS

| | | |
|---|---|---|
| DE | 10 2005 055 611 | 6/2006 |
| EP | 0 945 217 | 9/1999 |
| GB | 2 009 642 | 6/1979 |
| KR | 2001-0092021 | 10/2001 |

OTHER PUBLICATIONS

German Patent Office Report for DE 10 2008 035 730.8-14; mailed Feb. 21, 2009; 3 pages (German Language).

GEO: Die Mathematik der Brillanz, Sep. 2008.

Hans Schuh, “The Time”; Mar. 27, 2008; 5 pgs.

* cited by examiner

APPLICATION OF A PROCESSING PIN TO A GEMSTONE WHICH IS TO BE CUT OR POLISHED

CROSS-REFERENCE TO RELATED APPLICATIONS

This application is the U.S. National Stage filing of International Application No. PCT/EP2008/068243, filed Dec. 23, 2008, which claims priority to German Patent Application No. 10 2007 062 638.1, filed Dec. 23, 2007 and German Patent Application No. 10 2008 035 730.8, filed on Jul. 31, 2008, the disclosures of which are hereby incorporated by reference.

FIELD OF THE INVENTION

Embodiments of the invention relate to an improvement in a production method for cutting and/or polishing gemstones. The original production method has been handed down over many centuries and has been tried and tested and proven worthwhile.

BACKGROUND

Exemplary embodiments relate to applying a next follow-on pin as a handling or processing pin to the stone to be cut, which is previously held by a preceding pin which serves for example as a measuring pin in preceding measurements on the stone to adapt the geometry of the rough stone to be cut, in particular a rough jewel, in the best possible fashion to a shape to be obtained for a cut jewel, or vice-versa.

The jewel, in its desired geometrically predetermined shape, should be utilised in the best possible fashion, with a reduction in the loss of rough volume (in particular it should be of a volume-optimised configuration).

The procedure which has been tried and tested and handed down for centuries for cutting rough uncut jewels operates with a pencil-like holding pin and a normal wooden block which serves as an apertured board for insertion of the wooden pin, to the tip of which the rough uncut stone is fixed with a drop of resin, wherein insertion of the pin into the apertured board defines an angle of inclination which is required for the cutting operation and which is to be maintained as uniformly as possible in the cutting operation and later upon polishing. DE-U 85 04 419 (Landgraf) depicts this operation, for example on page 1, middle paragraph. It is only then that the cut and the fire of the resulting cut jewel can be achieved or improved.

After cutting of the first half of the stone the wooden pin is released by the influence of temperature, in which case the resin softens and a pin-change procedure takes place in which the stone is held with another wooden pin which is to be freshly secured at a different location using the same procedure, also shown in Landgraf, page 18, FIG. 8 and page 19, last paragraph with the ideas of 'changing cementing' according to page 9, middle paragraph. For that purpose the stone is turned and on the wooden pin fixed thereto again fitted into the hole in the apertured board to be able to cut and polish the opposite side of the stone.

That side also requires the highest possible degree of consistency of maintaining the angle for the facets to be cut, the apertured board making it possible to adjust the cut angles in a raster grid of half a degree.

In the operation of changing pins in the foregoing sense, there is a change in the processing zenith, from the 'northern hemisphere' to the 'southern hemisphere' of the rough jewel to be cut. In that pin-changing operation the experienced operator is reliant on his own judgment, fingertip feel and his optical assessment to position the follow-on pin in the 'pin-changing step' at a location acceptable to him for the stone thermally released from the first pin, just as he is equally reliant in the 'pin-fitting step', that is to say applying the first wooden pin, on his own perception and experience. In that respect the relationship of the two pins to be applied does not involve a defined reproducible accuracy, or only that accuracy which the experienced cutter can bring to the first pin application step and the second pin application step.

SUMMARY OF THE INVENTION

The object of the invention is to simplify and automate the operation of changing pins from a first pin to a follow-on pin and in that respect to achieve the accuracy required for automated processing when measuring and/or cutting and/or polishing to be able to retain co-ordinate systems for orientation and geometrical placement of the either rough, semi-cut or finished stone and transfer such systems in the pin-changing operation (in a computing or controlling process computer).

To attain that object the invention provides methods and apparatus' as described herein. Pins for measuring and processing the stones are provided.

In that respect the pin-changing operation involves on the one hand changing from a measuring pin to a first follow-on pin as a processing or handling pin. The pin-changing operation in the sense of this object however also involves the change from a first handling or processing pin to a second handling or processing pin, to be able to process the other hemisphere (the profile opposite to the rondist plane of the stone which in that respect is still rough), in particular to be able to cut and/or polish it.

The method of applying the next processing pin, referred to for brevity as the 'follow-on pin', begins with mounting or 'fixing' that pin to the either rough stone or to the stone which is at least half finished cut and polished. The application operation is effected by way of a second adhesive bonding location spaced from the first adhesive bonding location at which the old pin is still fixed as the preceding pin.

Preferably the second adhesive bonding location is arranged on a surface portion of the stone which is defined in alignment with the axis of the first preceding pin but that geometrical relationship is not imperative. Placement of the new pin at an angle greater than or smaller than zero in relation to the pin which is still held makes it possible to predetermine the position of the stone to be processed relative to the new pin (first processing pin). When changing from the first to the second processing pin the preference is for axial alignment.

The expression 'fluid adhesive' for the glueing or adhesive bonding location is intended to denote all possible materials which have glueing or adhesive properties, have a viscoplastic state and can set. Examples of temperatures at which the viscoplastic state occurs is the room temperature in which the equipment operates. Setting should occur to an extent which fixes the stone to the respective follow-on pin with sufficient adhesive force to be able to process and handle it in the sense of cutting and polishing it. Examples of such adhesives are resins as are usual at the present time.

The fact that the various pins must perform different tasks means that they are geometrically different in configuration, thus in regard to the handling and/or processing pin and the measuring pin. Their transposition or interchange is referred to as the pin-changing step, in which case a preceding pin is changed for a next pin and in an intermediate condition the stone bears both pins, or arranged on the stone are two pins which are arranged with a respective adhesive bonding location and which would both be capable of bearing same but the pin is held and moved only on one of the pins, with a free-standing second pin.

With a preceding pin as the measuring pin the next pin as the follow-on pin is the first handling or processing pin. If the other hemisphere of the stone is to be processed a first handling and processing pin is replaced by a second handling or processing pin, which can both be of the same geometrical configuration but which are arranged in opposite relationship (on the same axis) and therefore in surface-spaced relationship, temporarily both and for the processing operation only the pin which is arranged later and which remains in glued or bonded relationship on the stone, in contrast the previously arranged handling and processing pin is separated from that stone.

The stone is firstly held to the preceding pin. The pin is also held to that preceding pin during the initiation of the change procedure (pin-changing operation). The follow-on pin, in the above-indicated sense, is arranged at a spacing from the location at which the preceding pin is glued to the stone, or vice-versa. For that purpose the follow-on pin receives at its front end a viscoplastic adhesive, in particular a resin or a kind of resin which can set. The follow-on pin is moved towards the application location on the stone with that adhesive—at a spatial distance different from contact-to-contact—until the above-mentioned axial front end of that follow-on pin and the stone touch.

The movement towards each other can also take place in the reverse relationship so that in relative terms reference should be made to a reduction in the spatial distance of the stone and the coated front end of the follow-on pin. When both pins are placed on the stone the fresh contact location is hardened as the second adhesive bonding location. For example by thermal influence or by the influence of light from a ultraviolet ("UV") source which is positioned with its beam on the adhesive bonding location.

Positioning of the follow-on pin has the result that there is a change in the way in which the combination of both pins and the stone is held.

The stone with two pins is now held by another holding device, for example a clampable jaw device or a chuck, so that the old pin projects freely. The positioning of that old pin as the preceding pin under a heat-supplying source provides by thermal conduction for a feed of thermal energy to the first adhesive bonding location. The heat is preferably introduced by a hot air blower and a nozzle concentrating the hot air to act on the preceding pin and to be introduced by way of that pin into the first adhesive bonding location by thermal conduction.

In that respect a further spacing is provided as a distance, meaning that the thermal energy predetermined by hot air does not directly influence the first adhesive bonding location, but with the interposition of the first pin and at least a portion of its geometrical length. Because the pin is in the form of a metal pin or comprises such a material which is metal-like and can conduct heat, the first adhesive bonding location is locally targetedly weakened and then softens.

The adhesive bonding location which is weakened in that way and preferably also softened can now be separated off or released.

Release is effected by applying a force component, for example a transverse force, acting outside the axial direction of the two pins, preferably perpendicularly thereto. That force component acts on the preceding pin as the pin to be separated off. With the release force, the weakened adhesive bonding location is physically released and the pin is separated from the stone, in particular in the form of simply dropping down in the case of a force acting vertically from above. Other directions for the release force are inclinedly from above or rearwardly along the axis in the form as a pulling force.

The follow-on pin which was previously joined to the stone at the second adhesive bonding location still holds the stone and after that follow-on pin is gripped in a handling arm, preferably in a jaw device, the stone has not experienced any relative movement with respect to the one pin or the other, until the release or separation operation.

Highly accurate transfer of the co-ordinate system applied in the stone can be effected in that way. The two placements of the adhesive bonding locations are exactly such that at no time can there be an inaccuracy in respect of such positioning and the precise geometrical axis through the two pins. That accuracy is provided in particular for all pin-changing operations.

With the choice, which is in itself free of the first adhesive bonding location (for the measuring pin) and a presetting, controlled by the program system, for the second adhesive bonding location (first processing pin) as well as the third adhesive bonding location which is oriented in aligned relationship with the second adhesive bonding location on the axis of the pin (second processing pin), measurement is optimised and the sequence of processing the hemispheres is established. In that respect there is a certain dependency or influencing which cannot be directly predicted.

The influencing effect firstly arises due to the appropriate presettings to be selected for the measuring pin and for the first processing pin. The measuring pin has a very thin application or mounting shaft with which it is to be fixed to the rough stone by a first adhesive bonding location. For that purpose, having regard to two criteria, a position is sought which is appropriate for the fixing in order then to have the greatest possible optical free space for optical measurement. For that purpose a location on the stone would have to be selected, which is of no interest in terms of measurement (as a blind spot results here) and which has a certain surface area in order to lie in a favorable position relative to the thin application pin and to be easily compensated by programming. As in the step of applying that measuring pin the stone is firstly considered in rough form without knowing what precise position a form of design will later have within the rough stone, the choice of an initially human worker cannot be directed to the entire production process or review it, but is firstly primarily concentrated on the initial task of good measurement and appropriately holding the pin for measurement purposes as well as ease of calculation (compensating for the blind spot by programming technology).

After the measuring pin has performed its task, the rough stone has been measured and a processing pin is to be glued at a spaced location from the first adhesive bonding location, it is established how the first cutting operation proceeds.

In that respect the processing pin is not necessarily arranged in axial alignment with the measuring pin, but primarily as is required by the following processing operation, and as the handling system allows in positioning of the processing pin. At the same time in that respect it is established whether the processing operation controlled by the program system (firstly primarily cutting of the tip end or the flat end of the design shape) is effected. In that respect the controlling program system can switch over and compensate.

In that respect the feed of the first processing pin by a handling system is adjustable only in a certain angle, at any event less than three-dimensionally 180°, so that there is only a limited directional presetting, for tool reasons. Within that hemisphere, the application of the first processing pin is to be such that the first processing operation is on the flat side of the shaped jewel (the table side) or is effected from the point side of the shaped jewel (from the pavilion side). The position of the shaped jewel in the rough stone is only established after measurement and prior to that measurement operation the measuring pin was arranged so that those two associations are not always optimised with each other and are often dependent on the user feel.

That unpredictability (randomness) can be compensated by switching over the program system for the cutting process, insofar as that program system establishes, whether cutting begins from the table side or from the pavilion side, and precisely from that side which is possible by virtue of the spatial factors involved and on the basis of the adjustment angle of the handling member which feeds the first processing pin. If application of the first processing pin is not possible at the location that the program system provides for the first processing operation from the table side, the program system switches over in the indicated fashion and moves placement of the first processing pin according to the position of the adhesive bonding location and the direction of the first processing pin into the other hemisphere relative to the rough stone in order firstly to be able to begin cutting from the pavilion side.

The reasons why the first position which is actually reached cannot be reached by machine are machine limitations, collision with the measuring pin or the adhesive bonding location of the measuring pin. The program system then implements the change and compensates for the initially perhaps inappropriately selected placement of the measuring pin by way of the first adhesive bonding location.

The first adhesive bonding location should therefore as flat as possible because it must be worked out in accordance with optical detection by the program technology as a blind spot which is to be replaced by a surface contour that is as simple as possible. The follow-on pin, that is to say the first processing pin, should in contrast be arranged perpendicularly to the (optimised) rondist plane. That application in accordance with position and direction is already a consequence of the calculation and the position of the shaped stone in the rough stone. In this case there are two directions which are displaced through 180° and which predetermine whether the table side or the pavilion side experiences the first processing operation.

When applying the second processing pin to the third adhesive bonding location, in which case the rough stone is already half cut (from the pavilion or table side), the adhesive bonding location is oriented in precise axial alignment with the direction of the first processing pin which is still stuck to the stone, also calculated by the program system.

Preferably release and subsequent separation of the 'preceding pin' is exerted by a free-standing edge or a leg. For that purpose either the edge can be moved against the (preceding) pin to be separated, or vice-versa, which movement is preferred. The edge is also preferably arranged close to the heat source so that there is no need for long distances for the movement of the holding device as the handling arm; particularly preferably the edge is arranged above the outlet for the hot air.

In that case the stone is moved as a combination of stone and two pins arranged thereon until the time at which one of the two pins is released and separated off at the edge or the leg. A relative movement of the stone with respect to both pins does not take place after application of the new pin, until release or separation of the old pin. That period ensures accuracy of transfer or retention of the co-ordinate system for the stone.

It will be appreciated that the effect of heat does not act straightaway but the first adhesive bonding location can be quickly weakened by virtue of a sufficient input of energy. For example the more strongly a blower of a hot air device acts on a pin to be separated off, and the better its thermal conduction in the longitudinal direction, the corresponding more quickly can the adhesive bonding location be weakened and also in particular also softened.

The precise punctiform input of thermal energy into the adhesive bonding location without surrounding losses to the stone can ensure that the stone is not thermally loaded and in particular is not overloaded, which could reduce its quality and in particular could also entirely burn it.

Although the application of heat to the pin involves a certain time delay caused by thermal conduction, it is possible to prevent the stone suffering from thermal shock so that thereafter it can no longer be cut. In a cutting operation after such a thermal shock it would split or break.

Preferred materials for the pins for measuring or processing or handling are all kinds of metals and metal alloys, particularly preferably brass.

Other ways of applying thermal energy are the application of current through a portion of the pin, the introduction of magnetic fields with eddy currents in the pin and transmission of the thermal energy produced thereby, like also finally contact with a thermally hot article.

Optimisation trials have shown that, with a blower of a hot air device, a time of not more than 40 seconds, preferably less than 20 seconds, is required for the measuring pin to introduce sufficient thermal energy into a pin to release the adhesive bonding location. The temperature is between about 80° C. and 100° C. whereby the stone (jewel) is not thermally excessively loaded, but at the same time the forces still required in shearing off the pin do not become excessively great.

The thermal energy introduced is propagated by thermal conduction in the pin to the adhesive bonding location which in that way can be thermally weakened in spot-accurate relationship. It will be appreciated that in that case the thermal energy is passed practically exclusively in the longitudinal direction of the pin (which is to be separated off). It can be mentioned in that respect that the first pin to be separated off is firstly the measuring pin, that is to say that which served to measure off the stone and which served for associated accurate holding thereof.

When the stone then experiences the first processing stage, the measuring pin is no longer required. The remaining adhesive residue at the first adhesive bonding location which remains after the measuring pin has been separated off is removed in the cutting operation.

When the pin passes into the second processing operation the other hemisphere is processed, to which the preceding handling and processing pin is fixed. That fixing is then to be released and the fresh application of a further handling or processing pin is effected in the way as described herein, by thermal weakening of the adhesive bonding location of the first handling and processing pin, the mechanical release force component, preferably in the form of a transverse force, and release and subsequent separation of the first handling and processing pin that is now no longer required, wherein the second handling and processing pin has been previously attached at the oppositely disposed location of the surface of the stone, as was described hereinbefore with a more general position for the first handling or processing pin which was adhesively bonded in the region of the opposite hemisphere in alignment with the normal to the table plane.

In regard to the minimum length of the spacing at which the heat is introduced into the pin intended to be released, measurements and trials have shown that that location should occupy at least half the length of the pin to be separated. As the pins themselves can be of a very different length, to protect a valuable jewel it can be said that the spacing should be at least 2 cm and thermal conduction can occur over that 2 cm, for thermally softening the adhesive bonding location.

By virtue of the different working operations to be effected with the pins the front ends of the pins are of different configurations. The measuring pin has a front which is of the smallest possible area, with little area or cross-section, in order to cover as little as possible of the stone which is firstly to be measured.

If handling and in particular processing is required a larger area at the front end may be appropriate to be able to apply higher forces for cutting and/or polishing so that the handling or processing pin should be of an area of greater than 4 $mm^2$ at its front end.

The measuring pin should preferably be smaller than 3 $mm^2$ at its front and the areas of the front ends of the two different pins should preferably differ by greater than a factor of 2.

The different functions to be implemented by the at least two pins used for holding the stone define their geometry, in which respect they are not completely different but not more than half. The measuring pin for measuring off the stone serves to hold the stone to measuring it off in a measuring station in such a way as to establish a co-ordinate system that that stone bears for further processing and is and remains associated therewith from the computer. The handling pin, in particular also for processing in the sense of cutting or polishing, takes over the measured stone for the above-mentioned further handling thereof, in particular processing. For that purpose the handling or processing pin is of a particular configuration at a front end.

A further handling or processing pin provided for processing the opposite hemisphere of the stone can look just the same.

The measuring pin and the processing pin have an identical rear portion so that both pins can be serviced, gripped and set down by the same handling systems. That purpose is served by the intermediate portion having for both pins a gripping zone which can be gripped with a handling system, in particular a gripper arm having front jaws which are displaceable in parallel relationship, and can be clamped between the jaws. The pins are different above the gripping zone while the pins can be the same beneath the gripping zone.

A circumferentially symmetrical gripping zone is provided as the gripping zone. It extends over the entire circumference of an intermediate portion which is assumed to be round so that the pin can assume any circumferential position in a store from which a handling arm would seek to remove it. A circumferential groove-shaped notch is particularly preferred. That allows the jaws of the handling arm to have projections with which they can engage into the notch in any rotational position of the pin.

An identification mark is also provided in respect of both pins, being identical, which allows the rotational position of the pin to be reproducibly detected or to be recognised with measuring systems. In particular that marking is a radially extending leg, also referred to as a radial leg. In that way a system which knows the co-ordinate system of the stone can set itself to the lying or standing pin orientation which is precisely involved in the process at that time, for example by co-ordinate transformation, based on the marking.

The marking is oriented from the gripping zone towards the front side (or front end), which configuration is preferred, so that the measuring pin and the processing pin are also of the same configuration in that respect.

The respective holding portion which is the portion at the front end is of a different configuration. The respective shaft portion is preferably of the same configuration, which is arranged on the opposite side of the gripping zone.

The holding portion in the processing pin is at least portion-wise conical, the conicity extending towards the front end. The conicity serves to reduce the diameter of the gripping portion (gripping zone) towards the front end which is applied to the stone by way of the adhesive.

The application area in the case of the processing pin is at least 4 $mm^2$, preferably larger. The adhesive is applied to that surface in order then to be adhesively fixed to the stone and hardened.

For a particularly large application area, the holding portion can also be in the form of a double cone. Firstly the diameter is reduced from the gripping zone along the first cone, then the holding portion increases in thickness again towards the front side so that the double cone over the length of the holding portion affords a constriction or narrowing, with a large adhesive surface area.

So that the handling devices can well grip the two pins the intermediate portion as the gripping zone is particularly pronounced. It is of a diameter larger than all other portions. That means that transversely relative to the axial direction the extent of the shaft portion and the holding portion is smaller than the transverse dimension of the intermediate portion. In the case of a round pin that interpretation can be applied to the diameter.

In the case of the measuring pin the holding end is also at least portion-wise of a conical configuration towards the front end in order to narrow from the gripping zone which is larger in the transverse dimension, towards the front end. The conical configuration is however substantially more markedly pronounced than in the case of the processing pin and in particular there is no renewed increase in diameter towards the front end but rather the front side (which is equivalent to the front end) is provided with an area no larger than 3 $mm^2$ as the application surface for the stone. That concerns the holding end in the front portion in front of, or above the gripping zone.

A set comprising at least one pair of measuring pin and processing pin is used for overall processing and measurement of a stone. In that respect the configuration of the measuring pin and the processing pin is described hereinbefore. In general however a plurality of stones is arranged on a plurality of measuring pins in order to be 'stored' or deposited with their shaft portions in a register until they are engaged by the handling arm at the respective gripping zone and fed to a process for optical measurement (for brevity: measurement) or to the pin-changing operation after a measurement procedure.

The set is therefore not to be restrictively interpreted so that not more than one measuring pin and processing pin are used, but at least one in each category is put to use in the overall procedure.

BRIEF DESCRIPTION OF THE DRAWINGS

The invention is described in greater detail hereinafter by means of a number of embodiments by way of example with reference to diagrammatic drawings.

DETAILED DESCRIPTION OF THE PREFERRED EMBODIMENTS

Figure 1:
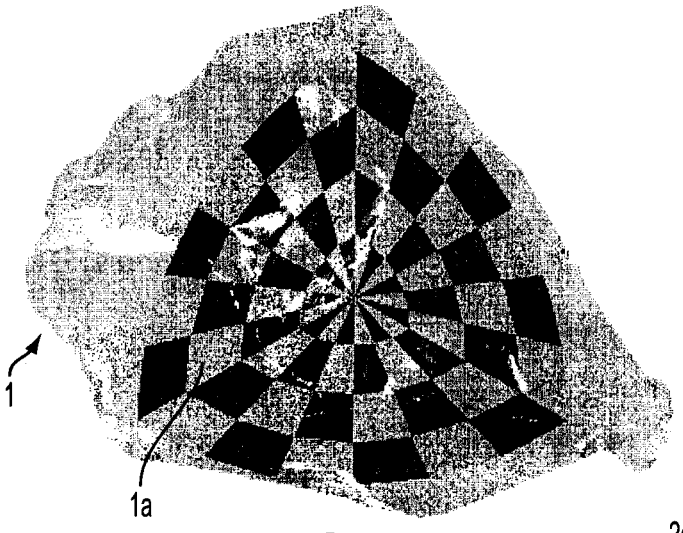
FIG. 1 shows a form of an uncut stone with a geometrical form 1*a* arranged therein of a cut jewel, the outside dimensions of which lie entirely within the outside dimension of the stone in the rough form 1. A trillion form is shown in the example.
Figure 2A:
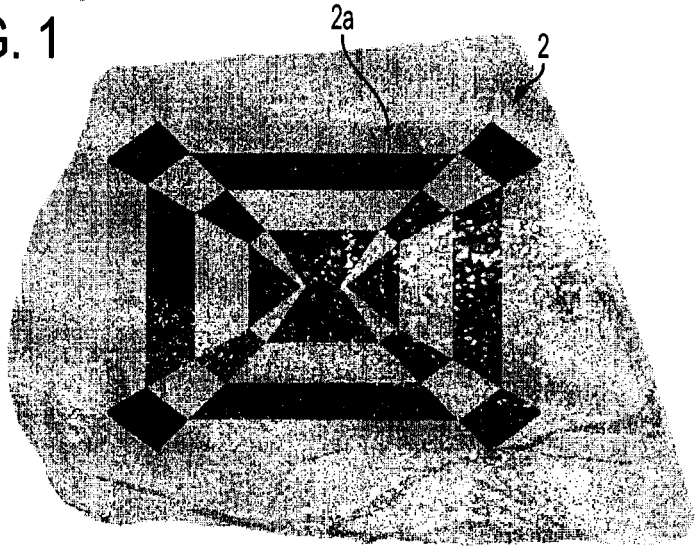
FIG. 2*a* shows a second form of an uncut rough stone 2 embedded with a second cut stone which acts in right-angled relationship and which has an emerald form 2*a*.
Figure 2B:
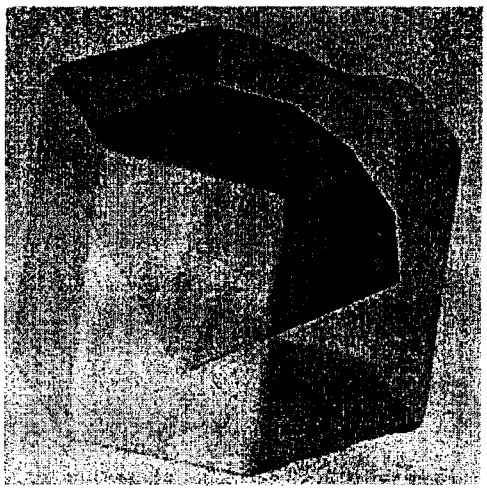
FIG. 2*b* shows a further form of an uncut rough stone 2 with embedded ground design form (intended) which acts in rectangular relationship and which is thus afforded by the program system.
Figure 6A:
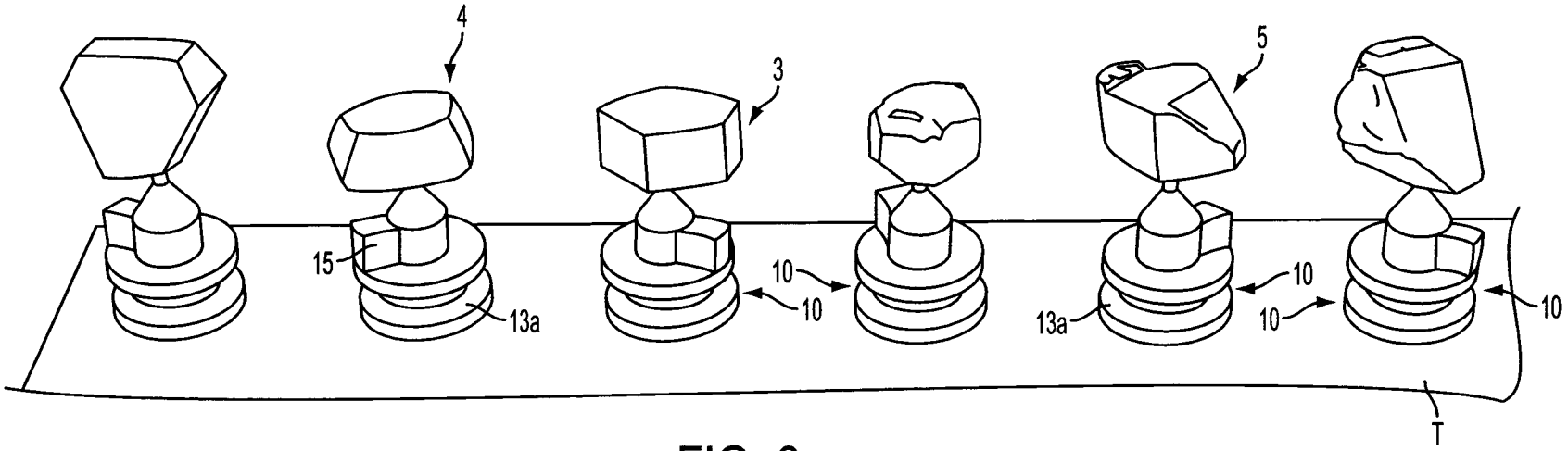
FIG. 6*a* shows a row of a plurality of measuring pins 10 which each bears a different shape of a rough stone (for example in the sense of an uncut jewel) and in that case are releasably fitted with their lower pin ends (shaft) at spacings on a common carrier bar T in order to be able to be removed therefrom. The stones 3, 4 and 5 are shown from the preceding Figures.
Figure 6B:
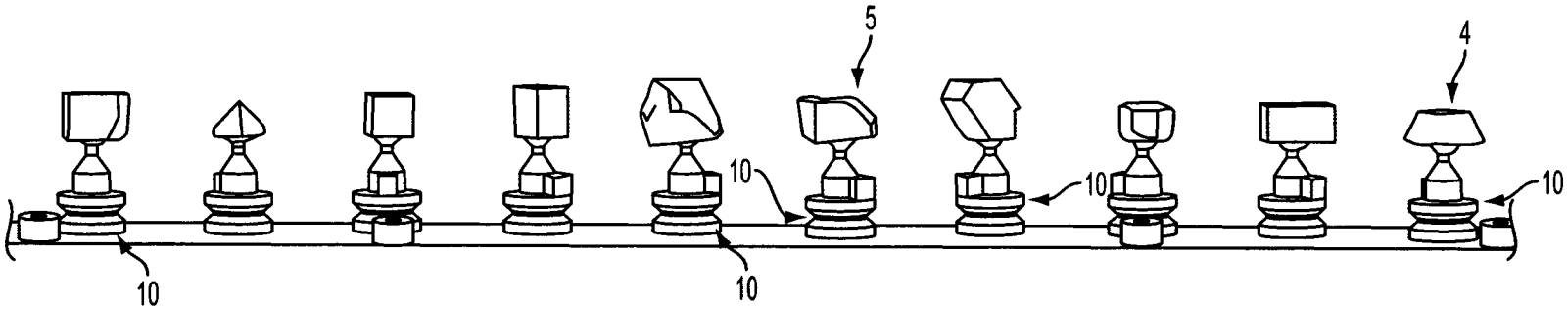
FIG. 6*b* is a further view of still further uncut stones which were already coated with a thin application layer and in that case respectively held by a measuring pin 10. The adhesive bonding locations at the underside of the respective uncut rough stone are particularly apparent, in conjunction with the respectively reduced-thickness front end of the respective measuring pin.

Referring to FIGS. 1 and 2, shown therein are various rough stones 1, 2 which also occur in the other examples as rough stones 3, 4 and 5. They each appear there in different forms, wherein FIG. 6*a* shows different forms of uncut stones, in particular rough gems, and FIG. 6*b* is a side view.

FIGS. 1 and 2 show how a form of a geometrically defined cut stone is introduced into an existing rough stone of a random configuration. Those forms 1*a*, 2*a* are to be placed in the best possible fashion there so that as little volume as possible of the valuable stone is lost when the stone is held, measured, handled and processed on the various pins to be described.

Figure 3A:
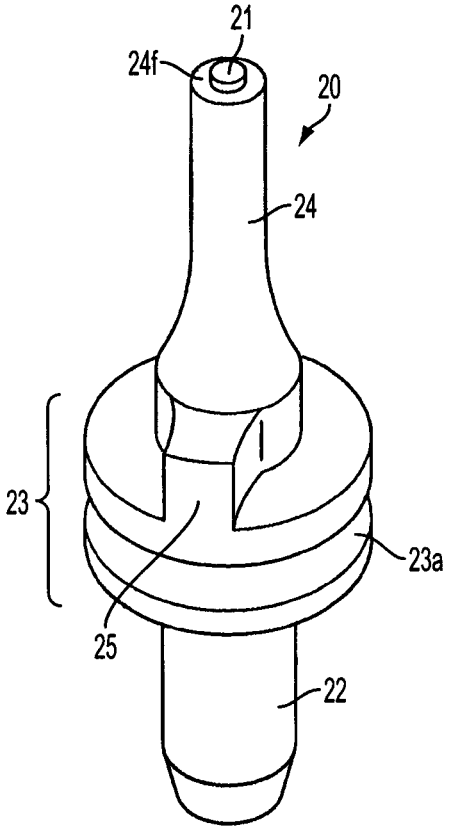
FIG. 3*a* shows a first handling or processing pin 20.
Figure 3B:
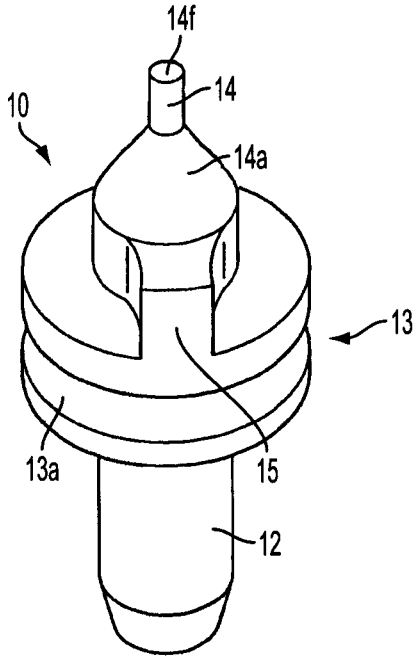
FIG. 3*b* shows a first measuring pin 10.
Figure 3D:
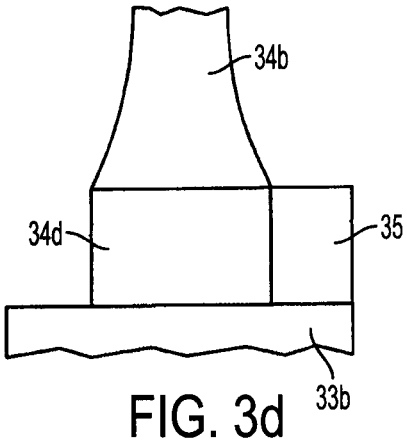
FIGS. 3*c* and 3*d* show a second handling or processing pin 30.
Figure 3C:
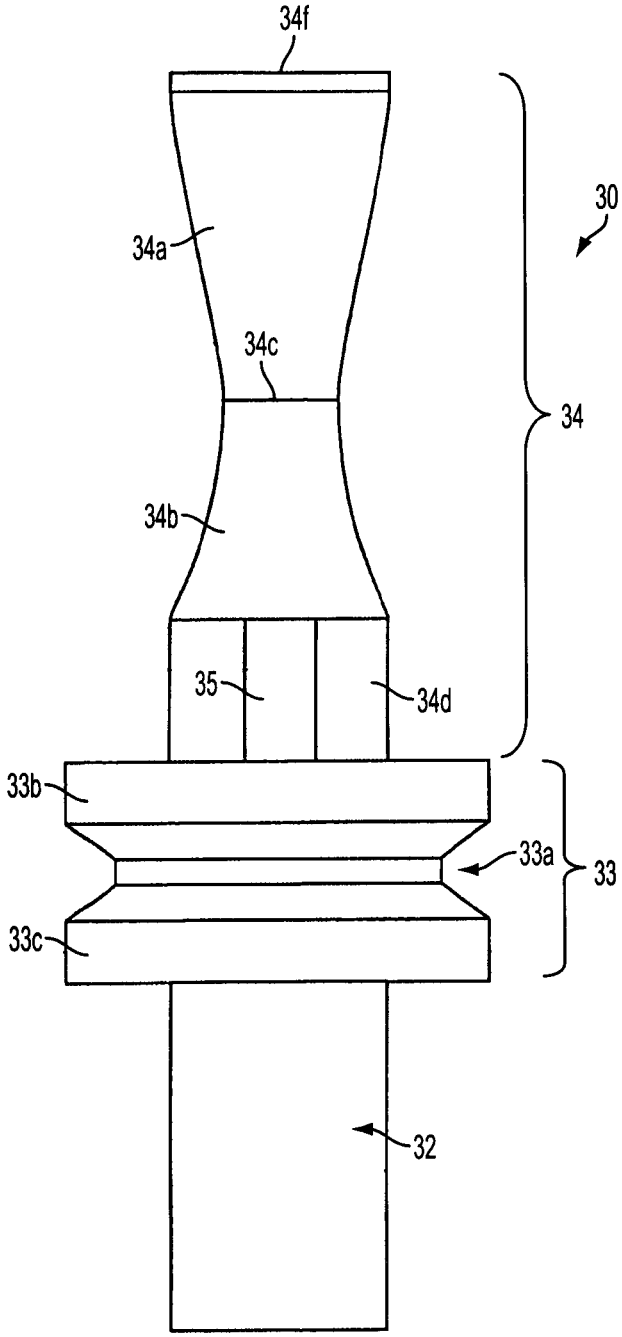
Figure 7:
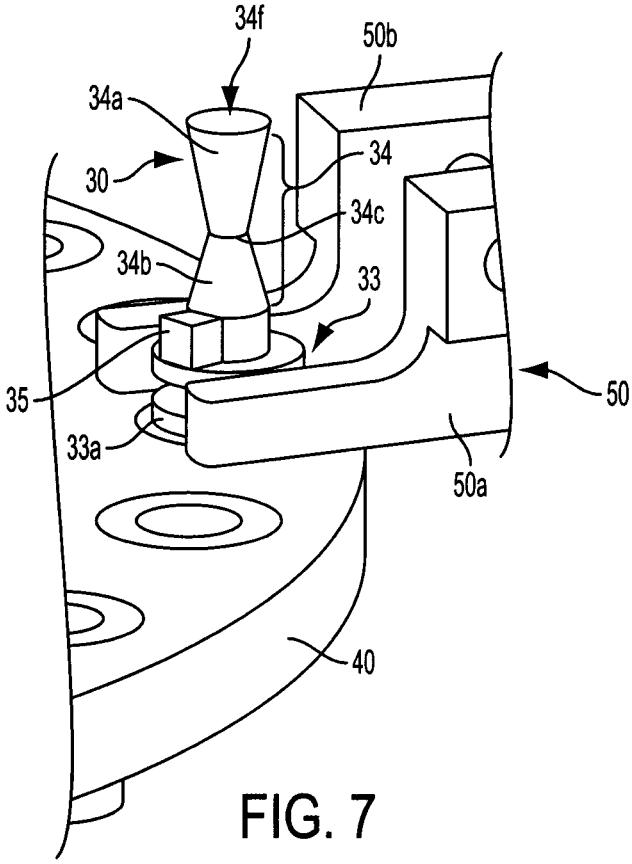
FIG. 7 shows the handling or processing pin 30 from FIG. 3*c*, which is removably held by a storage plate 40 in an opening, wherein a gripping device 50 with two jaws which can be moved apart engages a peripherally shaped holding zone 33*a* to remove the handling or processing pin 30 from the holding device 40 or—not shown—to fit therein one or more of those holding pins 30 to temporarily store them, wherein the handling or processing pin still bears no stone at its front end 34*f*.
Figure 8:
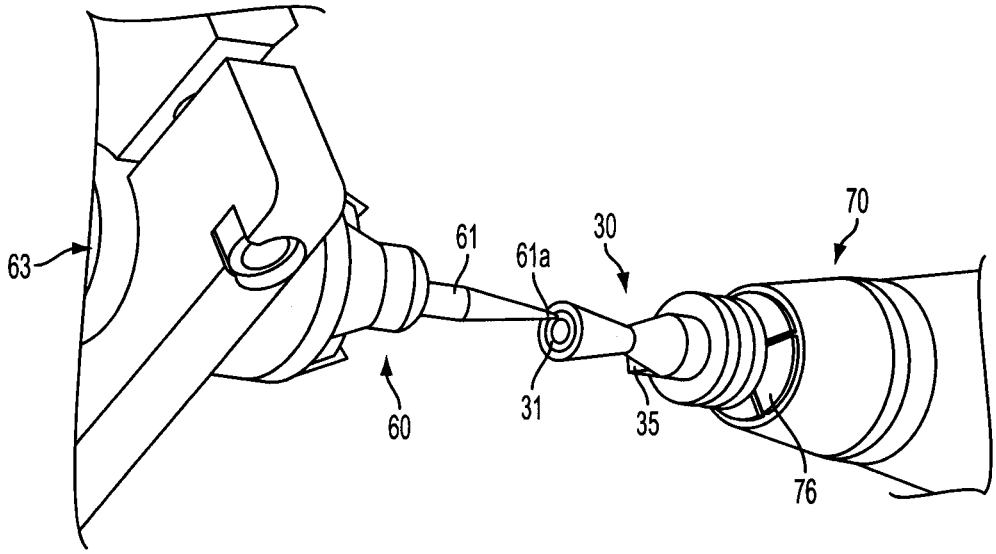
FIG. 8 shows the same handling or processing pin 30 of FIG. 7, fitted into a clamping or jaw device 76 of a handling arm 70, wherein an application device 60 applies a liquid adhesive 31 by way of a nozzle device 61, 61*a* to the enlarged front 'tip' of the handling or processing pin 30.

FIGS. 3*a* and 3*b* show two representatives of different pins. The pin 20 is a first handling or processing pin and the pin 10 is a first measuring pin. Another form of a handling or processing pin is the pin 30 as shown in FIGS. 7, 8 and 3*c*.

Figure 4B:
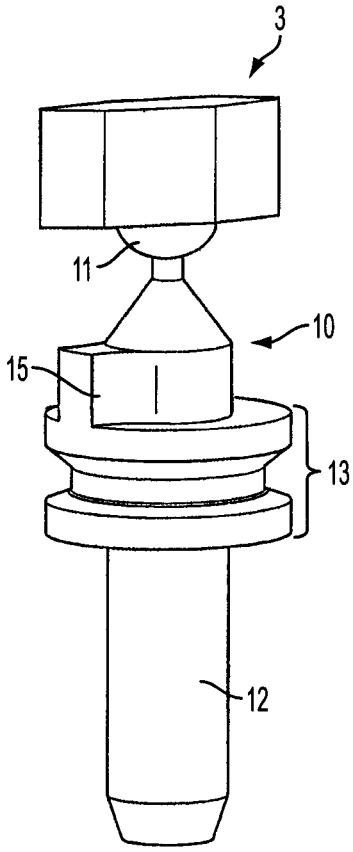
FIG. 4*b* shows the same measuring pin with another uncut stone 4, connected by way of the adhesive bonding location 11*a* to a front end of the measuring pin. The pins in FIG. 4 are turned through 90° (this can be seen from the identification mark 15).
Figure 4A:
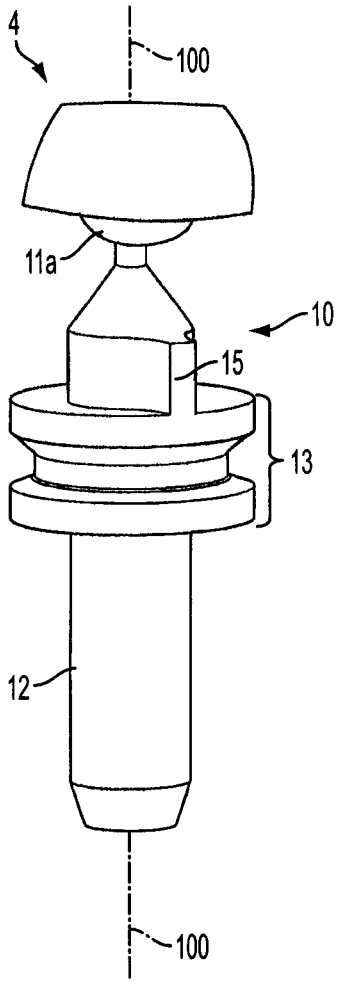
FIG. 4*a* shows the first measuring pin 10 with an uncut stone 3 arranged thereon by way of an adhesive bonding location 11.

The measuring pin 10 has a first shaft 12 and a thinner application or mounting shaft 14 with which it is fixed to the stone 3 by an adhesive bonding location, see, for example, FIGS. 4*a* and 4*b*. For that purpose the measuring pin narrows from a gripping zone as a gripping portion 13 to the application shaft 14. Preferably there is a conical portion which goes from a larger diameter to the smallest possible diameter for applying holding forces at the front end 14*f*. The cone portion 14*a* is integrally connected to a lug portion 15 which connects to the gripping portion 13.

Provided in the gripping portion 13 is a circumferential groove-shaped notch line 13*a* which corresponds in shape and cross-section to a corresponding notch line 23*a* of the handling pin 20. Both pins have to be handled and the handling devices can receive the measuring pin and the processing pin 20, move them and set them down again at a suitable location. For that purpose they grip the gripping zone with a suitably shaped projection.

The gripping zone is of a larger diameter than the other portions of the pins 10, 20 and 30.

The first processing pin 20 has a front portion 24 which is substantially longer than the holding portion 14 in FIG. 3*b* and which narrows in the course of its extent to a front surface portion 24*f* on which an adhesive 21 for producing an adhesive bonding location on the stone 3 is symbolically illustrated. That pin 20 also has a lug portion 25 in an integral transition from the described longer portion 24 to the gripping portion 23, in which the circumferential notch 23*a* is provided, for example in the form of a V-shaped or U-shaped groove which extends in circumferentially symmetrical relationship.

Provided at the opposite end is a shaft 22 which is of the same configuration as the shaft 12 of the measuring pin in FIG. 3*b*.

Both pins are of substantially identical configuration in the lower region and in particular the measuring lugs 25, 15 are harmonised (of equal width at least in the circumferential direction) so that on the basis of those lugs it is possible to establish the relative position of the pin to infer therefrom the relative position of the stone 3 arranged thereon by means of the adhesive bonding location. They serve for marking or for associated recognisability of the position so that they are functionally referred to as the 'marking portions'.

The other alternative of a handling or processing pin, hereinafter for brevity referred to as the processing pin 30, is shown in FIGS. 3*c*, 3*d*, 7 and 8. The lower portion 32 is again comparable. In this case also the holding zone 33*a* is in the form of a circumferential notch placed in the gripping portion 33. The lower shaft portion 32 cannot be seen in FIG. 7 as it is fitted into the receiving means of the holding plate 40.

The front portion 34, corresponding to the longer portion 24 in FIG. 3*a*, here comprises a base and two substantially conical portions 34*a*, 34*b*, oppositely directed, providing a narrowed zone 34*c* in the intermediate region of the portion 34. In that way the front portion 34 can perform two tasks, it can narrow from the gripping portion 33 and at the same time it can have a front 34*f* having a large area to be fixed to the stone 3 with a clearly defined adhesive bonding location in good holding relationship and capable of carrying high forces. A radial leg 35 forms the marking portion arranged on the base 34*d* of the holding portion 34 and above the gripping portion as the gripping zone 33. It has a respective annular plate 33*b*, 33*c* above and below the annular notch 33*a*.

The resulting narrowed zone 34*c* can be displaced further upwardly or downwardly.

Each of the handling or processing pins 20 or 30 hold a stone 1 through 5 with the first holding portion, are themselves held with the shaft portion 32 and have an intermediate portion which is larger in the extent transversely relative to the axial direction 100 than the largest transverse dimension of the first two portions. The respective intermediate portion as a gripping zone is of a circumferentially symmetrical configuration. An identification mark is provided on the side, remote from the shaft portion 22, of the intermediate portion, as a gripping zone. The holding portion for the stone has at least portion-wise towards the front (towards the stone) a conical configuration with at the front end a stone application surface which is at least 4 $mm^2$ in area.

The measuring pin 10 is also provided with a first shaft portion 12 for gripping the measuring pin, an intermediate portion 13 and a first holding portion 14 with a front 14*a*, wherein in the extent transverse relative to the axial direction the intermediate portion 13 is larger than a transverse dimension of the other portions 12, 14.

The circumferentially symmetrical gripping zone 18 and the identification mark 15 are also provided and are of the same configuration as in the case of the processing pin. Only the holding end 14, 14*a* which is at least portion-wise conical towards the front end has an application surface 14*f* at the front end for the stone, which is not more than 3 $mm^2$ in area.

The relationship of the application surfaces of the processing pin to the measuring pin is greater than 2, preferably substantially greater.

Figure 5:
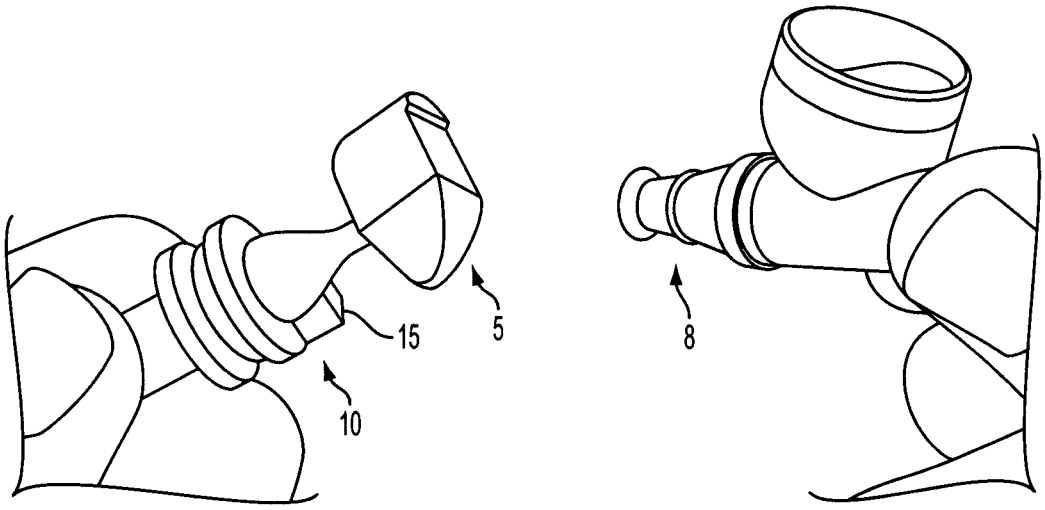
FIG. 5 shows handling of an uncut stone 5 on a measuring pin 10 with a coating device 8.

The side view in FIGS. 4*a* and 4*b* shows the mounted stone with an adhesive bonding location 11, 11*a* on the measuring pins 10 which are here of the same configuration. The different stones can be clearly seen once again in the rough stone register in FIGS. 6 and 6*a*. Their coating for neutralisation of the surface is effected in accordance with FIG. 5.

Here, an applicator device 8 is used to apply a powder to the surface of the rough stone 5, which renders its surface uniform and is opaque and preferably represents a white coating. That makes it possible to effect simplified measurement and more accurate optical measurement.

The coating is of a maximum thickness of 1/100 mm (in the sense of 10 μm) but is not critical and should not be excessively great to improve measurement.

The rough stones coated in that way are shown arranged in the register in FIGS. 6*a* and 6*b* on measuring pins 10, they can each be gripped at their gripping zone 13 in the circumferential notch 13*a* by a handling device and can be transported in the system for processing and machining.

Figure 13:
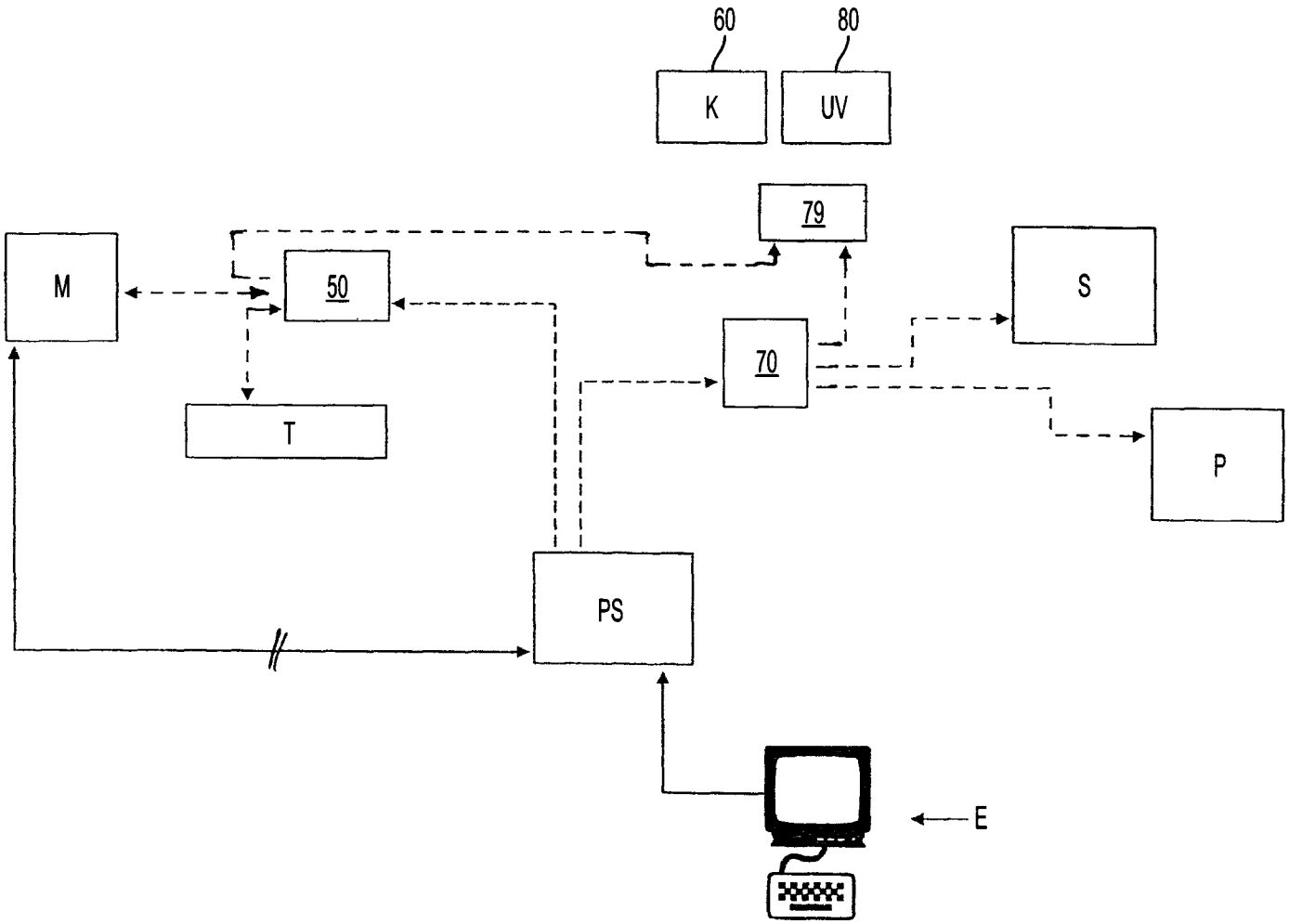
FIG. 13 shows an overview of the program system PS which controls the installation.

FIG. 13 shows an overview of the program system PS which controls the installation. The measuring station M measures the stone. The movable gripping device 50 moves the stone with measuring pin or the stone with handling or processing pin 30 (or 20) from and/or to a respective location. The respective one or a plurality of stones can be put into intermediate storage in the rough stone register in the form for example of a carrier bar T. A clamping or jaw device 79 holds the stone in the adhesive-changing step near the nozzle device 61, 61*a* and the UV hardening device 80. A handling arm 70 holds and moves the stone on the handling or processing pin to the cutting operation S and the polishing operation P. An input system E having a keyboard and a screen allows the user to intervene and the program system PS controls the installation.

Measurement and gauging M of the stones is described in detail here. It is to be assumed that the stones have been measured in a suitable optical measuring device in such a way that a co-ordinate system can be laid with one of its axes through the axis of each measuring pin 10, which accurately describes the stone. That co-ordinate system is to be retained for further processing and its relationship with the axis of the measuring pin 10 and the marking of the measuring pin 10 which was described with reference to FIG. 3*b* as a radial leg (lug) 15, also applies for any further processing operation with a processing pin 20 or 30 which has a measuring lug 25 or 35 of the same configuration.

In that sense the situation involves porting the stone from one pin to another, or interchanging the pin, and in so doing measuring the stone and then processing it twice, on each of its hemispheres. That is controlled by the program system PS shown in FIG. 13. The kind and manner of control is described in detail here and it should be appreciated that one skilled in the art can implement it in accordance with this description with current programmable components and elements.

This handling description is set forth with reference to FIGS. 8 through 12, in which respect it is assumed here that the handling and processing pin 30 is used, which has a larger front surface 34*f* which in particular is also geometrically roughened, for example by concentric rings.

Placed on the front surface 34*f* is an adhesive 31 which is firstly applied in liquid form by way of an applicator device 60. For that purpose the applicator device 60, provided with an adhesive storage means 63, is moved to the front surface 34*f*, or a handling device 70 with concentric jaws 76, at which the processing pin 30 is gripped, is moved to the stationary adhesive device 60. A narrowing nozzle 61 having a front end 61*a* applies a drop of adhesive, in particular in the form of a hardenable resin, to the surface 34*f*, which can be appreciated by reference to FIG. 8.

Figure 9A:
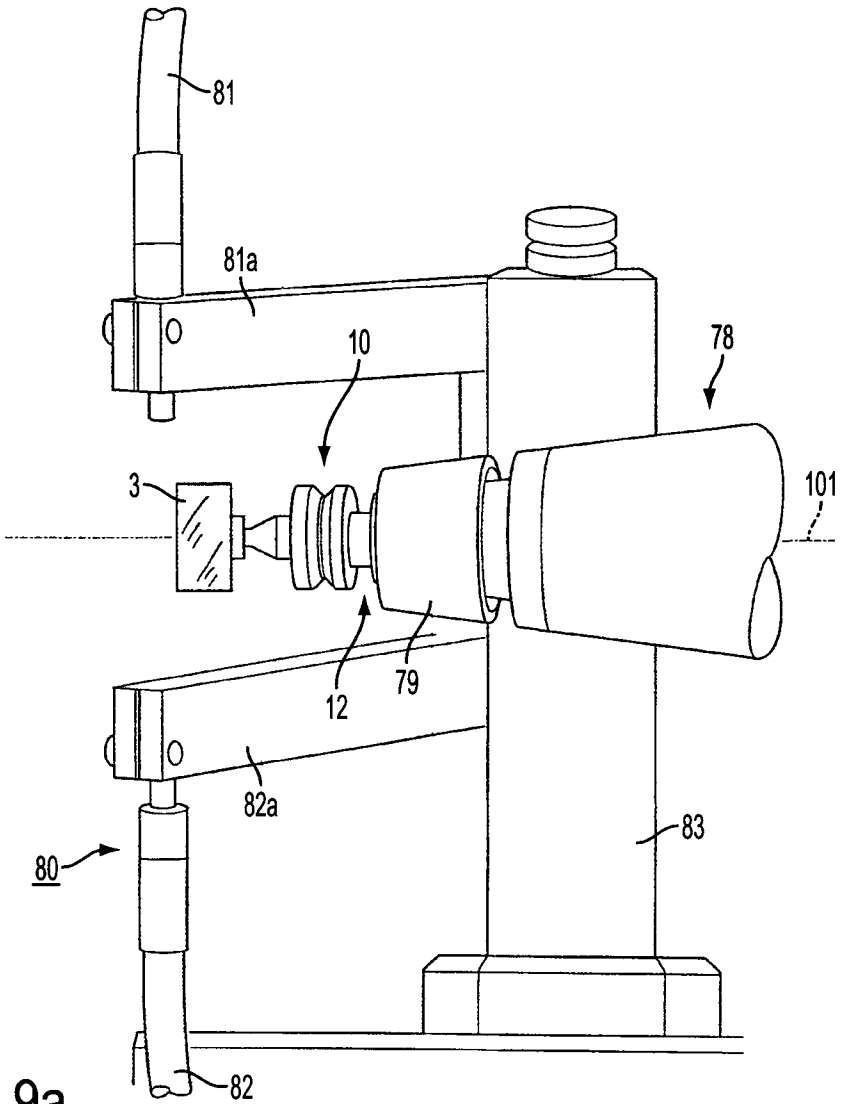
FIG. 9*a* show the approach movement of the handling or processing pin 30 to the handling arm 70 (towards the right in the drawing) and with a front-applied adhesive 31 in the direction of a stone 3 which is held by a measuring pin and which is held and positioned gripped in another handling device 78 in a chuck 79 thereat on a rear shaft. A hardening device 80 operating with light can be seen with its optical fibers 81, 82 at that location at which the handling and processing pin 30 (as the follow-on pin) is to be applied with its front adhesive 31 to the stone 30. The movement of the handling arm 70 occurs theretowards.
Figure 9A:
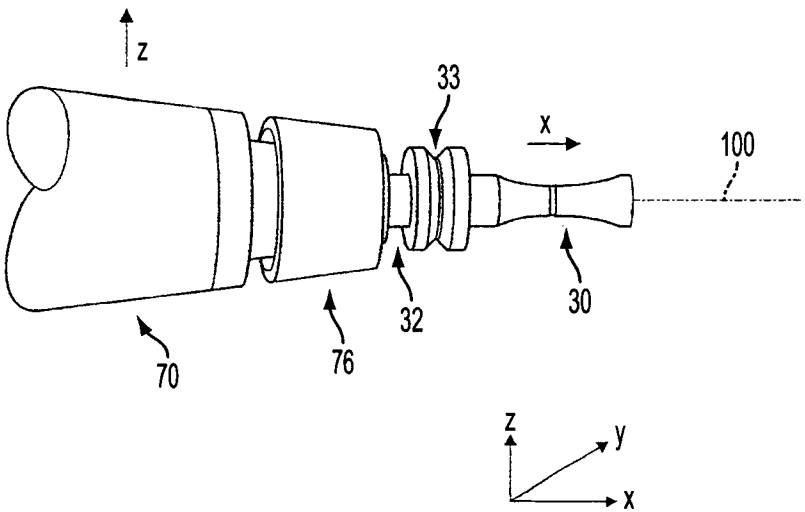

The processing pin 30 provided thus with an adhesive spot 31 is further moved to the handling arm 70 as shown in FIG. 9*a*. In that case it is moved to a stone 3 which is already gripped in another handling arm 78 and which is still fixed to the measuring pin is 10 with an adhesive bonding location 11. That measuring pin 10 is fitted in a further chuck 79 (chuck provided with clamping jaws) and waits in the working region of a UV hardening device 80.

The movement of the handling arms 70 in FIG. 9*a* towards the right goes to the point at which the adhesive spot 31 with the still hardenable (viscoplastic) adhesive bears against the vertically oriented front surface of the stone 3. In that case the spacing between those two objects is reduced, which is preferably effected by movement of the holding arm 70. When the point of contact is reached the adhesive 31 adheres to the processing pin 30 and the front surface of the stone 3 at the fresh adhesive bonding location 31'. Briefly switching on a UV light beam for a few seconds for it to act on the adhesive bonding location 31' provides for hardening thereof, for example by polymerisation. For that purpose there are provided two optical guides 81, 82 held by an upper arm and a lower arm 81*a*, 82*a* on a vertical carrier 83 to be able to cause the issuing free light beam to act from both sides of the adhesive bonding location 31. To compensate for different sizes of stone the arms are displaceable together with a vertical carrier 83. The light guides can thus be directed on to the adhesive bonding location 31' at least with their ends from which the UV beam issues.

That light action is not shown and can be replaced by other kinds of hardening devices, it only shows one example of fitting the new pin 30 as the handling or processing pin to the stone 3 which was previously held on the measuring pin 10.

Figure 10:
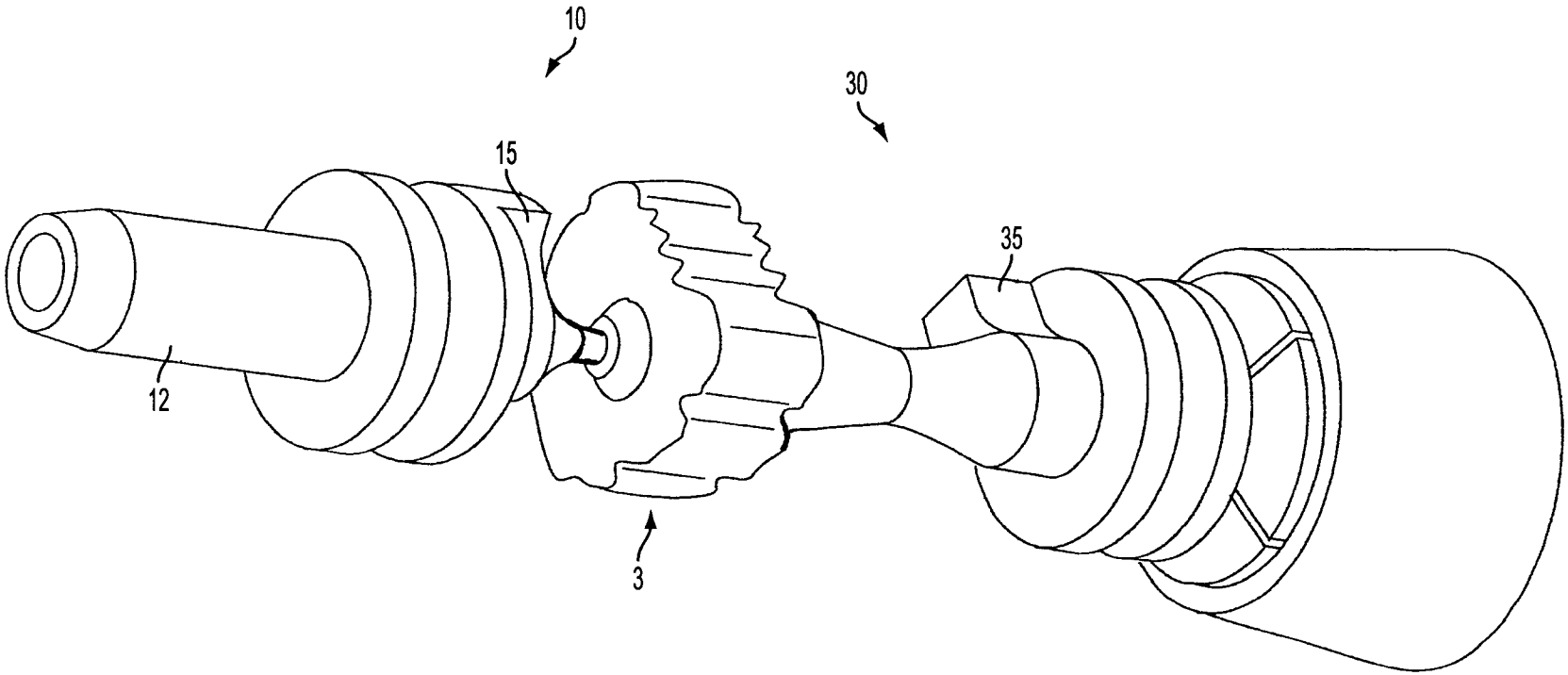
FIG. 10 show the handling arm 70 with gripped therein one of two pins 30, 10 which hold between them by way of a respective adhesive bonding location 11, 31 the stone 3 which is unprocessed but which is coated with an opaque surface. Both adhesive bonding locations 11, 31 are still active and non-released.

In an intermediate condition, as shown in FIG. 10, both measuring pins 10, 30 are fixed to the stone 3 with a respective adhesive bonding location 11, 31. The adhesive bonding locations are apparent as being upwardly curved portions in the drawing, while the markedly different diameters of the holding portions 14 and 34 of the two pins 10, 30 performing different functions are also apparent. The respective lug 15, 35 is also apparent, which does not have to be circumferentially precisely oriented relative to each other, which only has to be known to the control device in the relative circumferential differential position thereof in order to be able to transfer or carry over the co-ordinate system ported by the measuring pin 10, to the handling and/or processing pin 30.

Upon a change from one processing pin to another, the axes are aligned.

The axes 100 and 101 of the two holding portions 13, 34 are not in mutually superposed relationship in every case. For example, the axes are not in a mutually superposed relationship in the cases involving the change from the measuring pin to the first processing pin.

Circumferential rotation of the measuring lugs 15, 35 relative to each other, as shown in FIG. 10, is also possible. They do not need to be axially aligned. The program system calculates that in the co-ordinate transfer procedure with the change in the pins.

If the pins 30 are fitted at another angle the axes 100, 101 of the pins 10, 30 are at an angle of greater than or less than 0° relative to each other. That is achieved by a displacement of the handling arm 70 in the x-y plane and rotation of the stone 3 about the axis 101 with the clamping device 79. In that way the location of application of the resin 31 as the adhesive bonding location 31' and the angular position of the axes 100, 101 are established. They are in the free hemisphere, possibly limited in terms of three-dimensional angle to <180° by tool influences or freedoms.

Figure 9B:
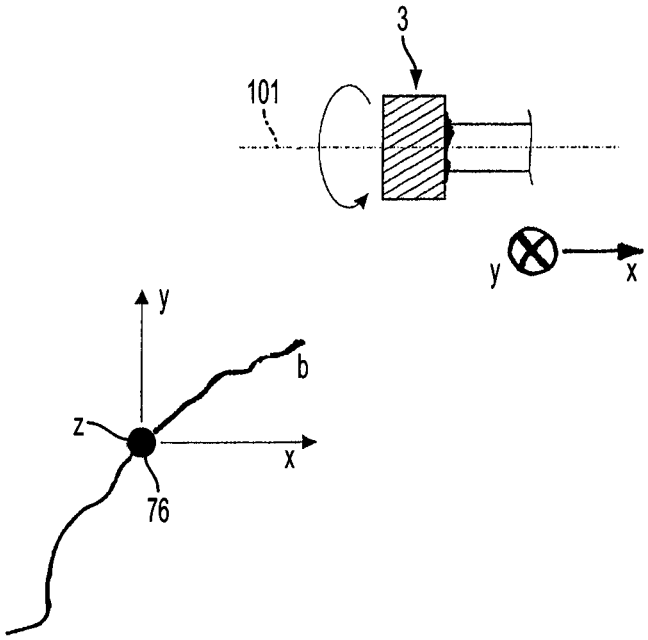
FIGS. 9*b* and 9*c* show different directions for applying the follow-on pin.
Figure 9C:
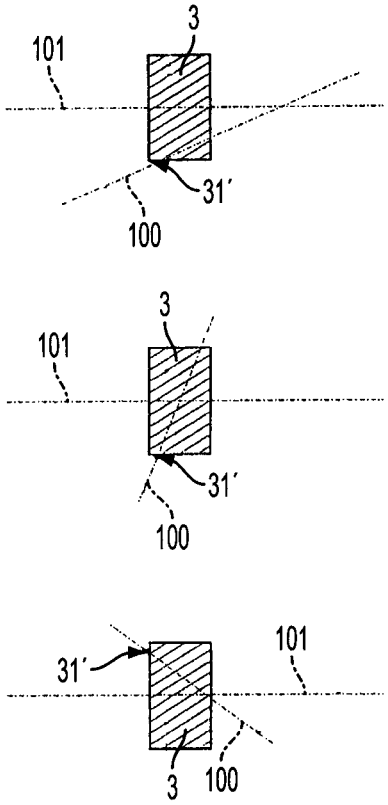

The various orientations of the axes 100, 101 are shown in FIG. 9*c*, in which respect it is assumed that an axis 102 lies on the axis 101, which axis 102 is the axis perpendicular to the intended table plane of the cut stone. FIG. 9*b* shows the approach movement of the arm 70 which is pivotable in the x-y plane and which is movable without upward/downward inclinability along the path b. The arm 70 is also displaceable in the height direction z. To fit the pin 30 in the x-y plane the stone is so turned by the other clamping device 70 that the perpendicular 102 to the table plane of the stone comes to lie in the x-y plane.

The program system suitably converts the co-ordinates or systems. An adjustable degree of freedom at the arm 70 can be eliminated therewith, which promotes accuracy and reduces the costs of that handling tool.

The new pin 30 is now fitted. The clamping device 79 releases so that the measuring pin 10 comes free and there is now a freely projecting pin 10, with its lower shaft 12.

Figure 11:
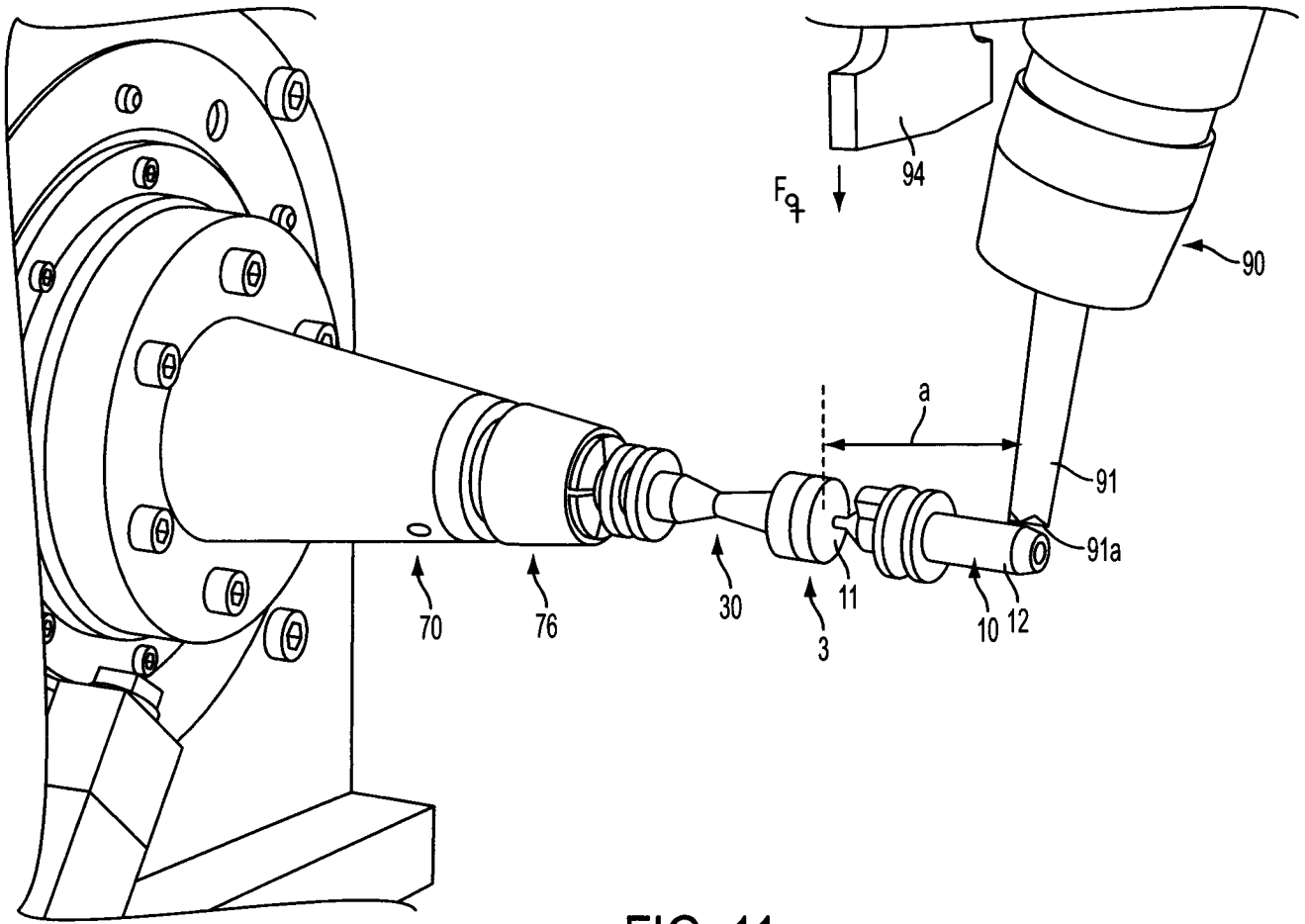
FIG. 11 shows the same arrangement in FIG. 10 with the handling device 70 which has moved the two pins and the stone 3 under a hot air device 90 which is directed towards the shaft 12 of the measuring pin 10; shown above that placement is a knock-off edge 94 which is placed immovably beside the conical portion of the hot air device 90.

The handling arm 70 with the second pin holds the combination as shown in FIG. 10. It moves that combination as shown in FIG. 11 to a hot air device 90 which is illustrated there and which causes a hot air flow to act on the portion 12 of the measuring pin 10, at an air connecting portion 91 having a front outlet 91*a*. The action occurs directly at the outlet 91*a* and at the spacing 'a' from the adhesive bonding location 11. The applied energy is passed into the adhesive bonding location in spot-accurate relationship due to thermal conduction so that the adhesive bonding location 11 is thermally weakened and in particular softened. After at the latest 10 seconds the adhesive bonding location 11 is so greatly weakened that a rearward-upward movement of the handling arm 70 and the jaw device 76 can initiate the operation of knocking off the measuring pin 10. For that purpose the combination of two pins and a stone is moved rearwardly and upwardly in order to be loaded with a transverse force symbolically indicated by $F_q$ at a knock-off edge 94 in the form of a leg or edge, on a leg of a corresponding longer configuration.

Upon an upward movement of the arm 70, a downwardly directed force component $F_q$ on the shaft 12 of the measuring pin 10 causes that pin to be knocked off and thus provides for release of the already weakened adhesive bonding location 11. In a further upward movement the pin 10 drops off entirely so that it is separated from the stone 3, also due to the transverse force $F_q$. Other directions of the releasing force component are a pulling force or inclined directions at angles of greater than 0° and less than 90° with respect to the axis.

Figure 12A:
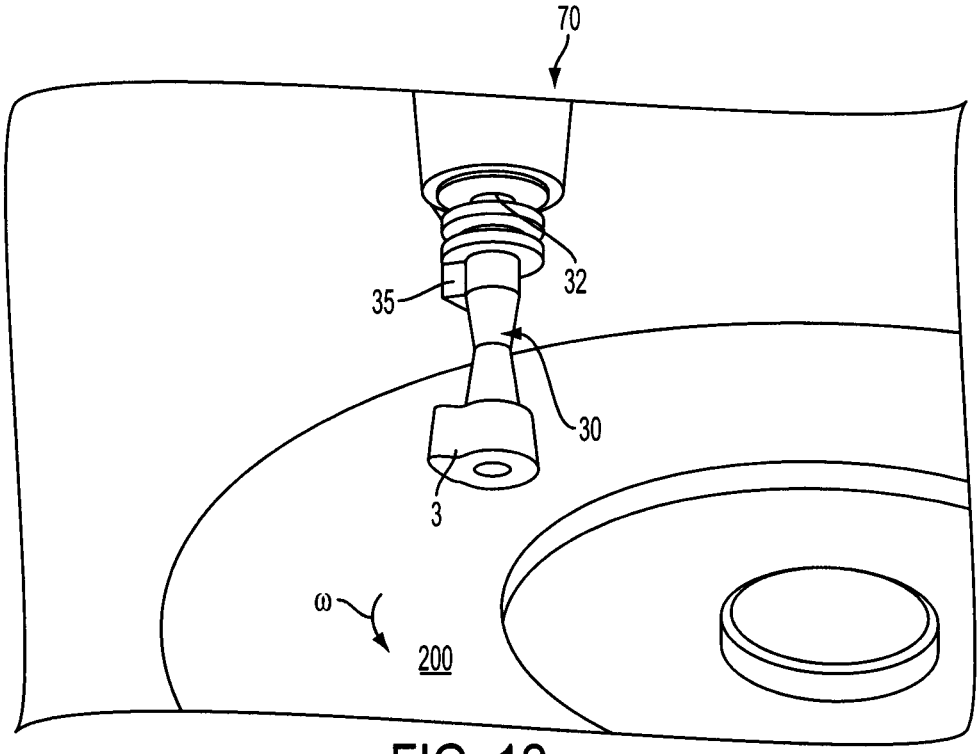
FIG. 12*a* shows the handling arm 70 as after release and separation of the measuring pin 10 and hardening of the adhesive bonding location 31, it places the uncut stone 3 on a cutting disk 100 moved at a high speed of rotation. The handling and processing pin 30 is gripped in the handling arm 70 or the chuck 76 thereof.

The resulting structure as shown in FIG. 12*a* is a handling arm 70 with a jaw device 76 carrying the measured stone 3. In this case the co-ordinate system has been transferred without a loss in accuracy and the control knows exactly in what rotary position and in what axial position the stone 3 is disposed with its geometrical extent, in a given position of the handling arm 70.

In FIG. 12*a* the control system has moved that handling arm to a cutting disk 200 which is moved at the angular speed ω (omega). By corresponding movement of the stone 3, a facet structure can be cut into the stone and in that case the remaining residue of the adhesive bonding location 11, as shown in FIG. 12, can be removed.

Figure 12B:
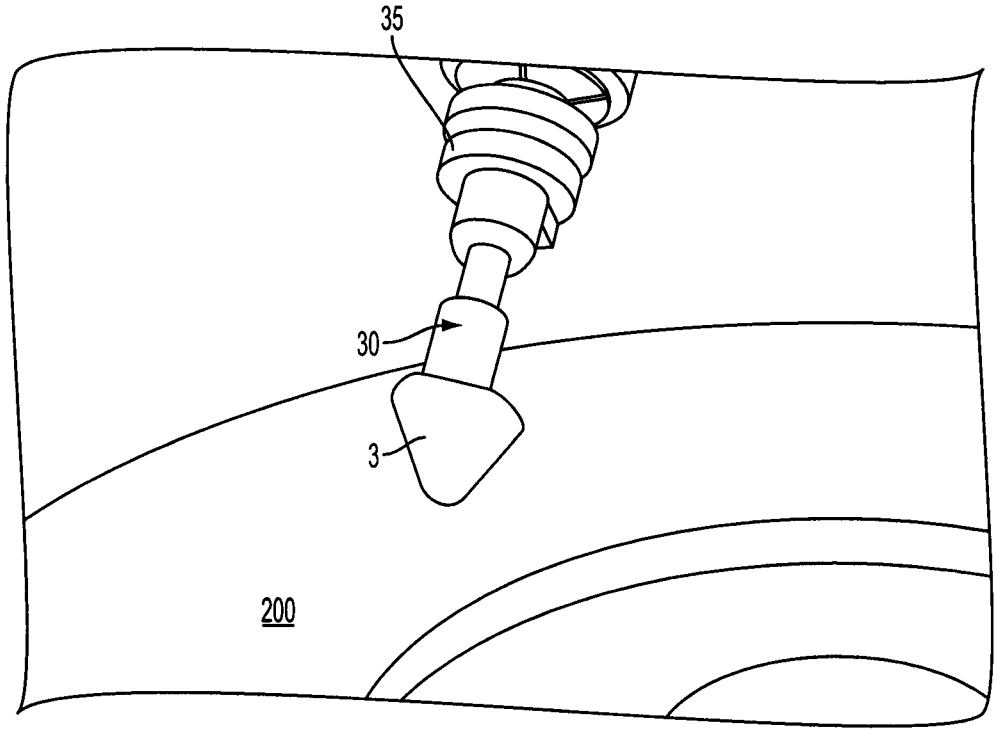
FIG. 12*b* shows the progress in processing, in which the same arrangement as illustrated in FIG. 12*a* is involved, and the handling and processing pin 30 holds the stone 3 to be cut, in the cutting operation, and in that case the surface of the stone is produced by removal of the coating and the formation of facets on the cutting disk 100.
Figure 12C:
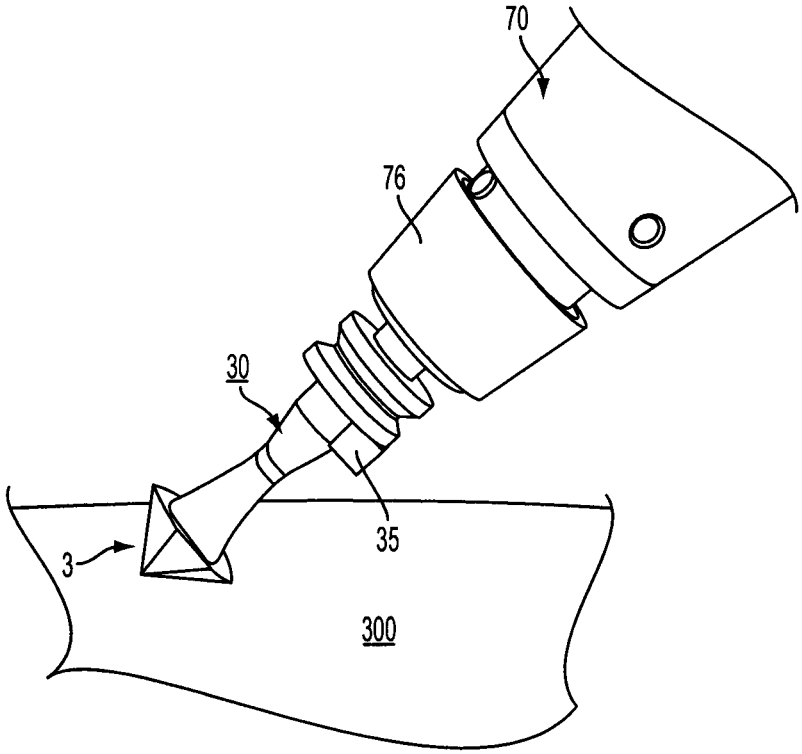
FIG. 12*c* shows a polishing operation after the cutting operation in FIGS. 12*a* and 12*b*.

FIG. 12*c* shows polishing on a polishing disk 300. The arm 70 on the chuck 76 holds and guides the stone 3 with the cut facet on the polishing disk. The relative rotary position and advance position can be measured by the marking 35.

The first processing operation is concluded by facetting and polishing of the first hemisphere of the stone 3, as shown in FIGS. 12*b* and 12*c*.

The second stage of processing the stone 3 as a follow-on from FIG. 12*c* is not shown but is readily apparent from the context.

In this case the processing pin 30 is replaced by another processing pin applied to the stone at the side which has already been processed. Application of the pin is effected as described hereinbefore for the pin 30, wherein the follow-on pin can be of a different geometry at its front end, for example it can have a small recess, but not necessarily so. In that case the axes of the pins are congruent.

When the stone 3 is also finished in its processing after processing of the other hemisphere on the opposite side in FIG. 12*b* on the cutting disk 200 and the polishing disk 300, separation of the last processing pin can also be effected. For that purpose a thermal influence is preferably also used, but not at a higher temperature, but cooling to below 0° C., preferably to −10° C., at which temperature the adhesive is released at the end of the stone that has already been cut so that the stone drops in the finished processed condition from the second processing pin.

In the claims defining the exemplary embodiments appended hereto, reference numbers have been included. These reference numbers are not meant to limit the scope of the claims but merely to provide reference to the Figures showing the embodiments described herein.

The invention claimed is:

1. A method of applying a next pin as a follow-on pin to a stone wherein the stone is held by a preceding pin fixed to the stone by way of a first adhesive bonding location, wherein the preceding pin (10) is to be separated from the stone to hold it with the next pin as the follow-on pin (20, 30), the follow-on pin is fixed to the stone by way of a second adhesive bonding location (21, 31) spaced from the first adhesive bonding location; wherein the stone is held by the preceding pin at least during an application of the follow-on pin;

the follow-on pin receives a fluid adhesive at a front end thereof and when still being at a distance from the stone and a space between the fluid adhesive carrying front end and the stone is reduced until the fluid adhesive contacts the stone;

the fluid adhesive is hardened at the contact location to build the second adhesive bonding location;

heat is transmitted to the first adhesive bonding location through the preceding pin, by introducing the heat into the preceding pin at a distance from the first adhesive bonding location to soften or weaken the first adhesive bonding location;

a mechanical force component as a transverse force is applied to the preceding pin to release and separate the preceding pin from the stone and holding the stone with the next pin as the follow-on pin at the second adhesive bonding location; and the stone (3) with next and preceding pins thereon is moved and the preceding pin as free-standing pin (10) is moved against and contacts an edge or a leg, while the stone is being held clamped in a chuck (76) at the next pin as follow-on pin.

2. The method of claim 1, wherein the introduced heat is transmitted by thermal conduction from the preceding pin (10) to the first adhesive bonding location.

3. The method of claim 2, wherein heat transfer by way of and through the preceding pin (10) is of such a magnitude that it is sufficient to soften the first adhesive bonding location (11) to permit separation and release of said preceding pin.

4. The method of claim 3, wherein a blower of a hot air device acts to release the preceding pin during a time period of not more than 40 seconds, wherein thermal energy is applied to the preceding pin (10) to release the adhesive bonding location.

5. The method of claim 4, wherein the blower provides hot air of a temperature that is between substantially 80° C. and 100° C.

6. The method of claim 4, wherein the period of time is less than 20 seconds.

7. The method of claim 1, wherein heat transfer by way of the preceding pin (10) occurs practically exclusively in the longitudinal direction of the pin to the first adhesive bonding location (11).

8. The method of claim 1, wherein the distance from the first adhesive bonding location, where the heat is introduced into the preceding pin (10) is at least half of a length of the preceding pin.

9. The method of claim 1 wherein the distance of a heating location, where the heat is introduced into the preceding pin is at least 2 cm.

10. The method of claim 1, wherein the preceding pin is a measuring pin (10).

11. The method of claim 10, wherein a front surface for receiving the fluid adhesive on the measuring pin (10) is less than 3 $mm^2$ in area and on the handling or processing pin (20, 30) it is larger than 4 $mm^2$.

12. The method of claim 1, wherein the preceding pin is a handling or processing pin (30).

13. The method of claim 1, wherein the handling or processing pin (20, 30) is of a heat-conducting material.

14. The method of claim 1, wherein an edge or leg is arranged above an outlet location (91*a*) for hot air of a hot air device (90).

15. The method of claim 14, wherein a blower of the hot air device acts to release the preceding pin during a period of time of not more than 40 seconds wherein thermal energy is applied to the preceding pin (10) to release the adhesive bonding location.

16. The method of claim 15, wherein the blower provides hot air of a temperature that is between substantially 80° C. and 100° C.

17. The method of claim 15, wherein the period of time is less than 20 seconds.

18. The method of claim 1, wherein no relative movement of stone (3) with respect to the pins (10, 30) occurs during a time interval after contacting of the follow-on pin (30) to harden the contact location, and a release of the preceding pin by contacting the edge or leg.

19. The method of claim 1, wherein hardening of the fluid adhesive is effected with UV light supplied by optical guides (81, 82).

20. The method of claim 19, wherein at least outlet ends of the optical guides are displaceable to provide adaptation to a size of the stone (3) and in an associated relationship therewith adaptation to a position of the second adhesive bonding location of the follow-on pin.

21. The method of claim 1, wherein a measuring pin (10) as the first or preceding pin is glued with an application surface (14*f*) thereof to a substantially flat location on the stone.

22. The method of claim 1, wherein the follow-on pin (30) as the handling or processing pin is not arranged in axially aligned relation with an axis (101) of the preceding pin (10) on the stone.

23. The method of claim 22, wherein a place for applying the next pin is determined by the fact, whether a processing of the rough stone that is carried out with said next pin, will be a table side or a pavilion side of the stone after said processing.

24. The method of claim 23, wherein said determining is effected by switching from a first to the other hemisphere in a program system controlling the place for applying the next pin.

25. The method of claim 1, wherein during a change from the preceding pin to the follow-on pin (30) a system of coordinates referenced to the stone (3) is transferred from a coordinate system relating to the preceding pin to coordinate system relating to the follow-up pin.

26. The method of claim 25, wherein the transfer of the system of coordinates correspondingly takes place for another change from the follow-on pin as preceding pin to a next follow-on pin.

27. The method of claim 1, wherein the leg or edge is immobile.

28. The method of claim 1, wherein the mechanical force component is a pulling force to release the preceding pin.

* * * * *